US011486673B2

(12) United States Patent
Moore

(10) Patent No.: US 11,486,673 B2
(45) Date of Patent: Nov. 1, 2022

(54) WEAPON TRAINING AND FIRING AID

(71) Applicant: Dennis Joseph Moore, Mesa, AZ (US)

(72) Inventor: Dennis Joseph Moore, Mesa, AZ (US)

( * ) Notice: Subject to any disclaimer, the term of this patent is extended or adjusted under 35 U.S.C. 154(b) by 150 days.

(21) Appl. No.: 17/060,033

(22) Filed: Sep. 30, 2020

(65) Prior Publication Data

US 2021/0116205 A1 Apr. 22, 2021

Related U.S. Application Data

(60) Provisional application No. 62/916,043, filed on Oct. 16, 2019.

(51) Int. Cl.

| | |
|---|---|
| ***F41A 33/00*** | (2006.01) |
| ***F41G 3/26*** | (2006.01) |
| ***F41A 27/06*** | (2006.01) |
| ***F41G 5/02*** | (2006.01) |

(52) U.S. Cl.

CPC ..... *F41A 33/00* (2013.01); *F41A 27/06* (2013.01); *F41G 3/26* (2013.01); *F41G 5/02* (2013.01)

(58) Field of Classification Search

CPC ... F41G 3/26; F41G 5/02; F41A 27/06; F41A 33/00

USPC ..... 89/41.01

See application file for complete search history.

(56) References Cited

U.S. PATENT DOCUMENTS

| | | | | | |
|---|---|---|---|---|---|
| 253,924 | A * | 2/1882 | Hotchkiss | F41A 9/36 | 89/37.15 |
| 628,840 | A * | 7/1899 | Normand | F41A 27/06 | 89/37.11 |
| 2,458,956 | A * | 1/1949 | Motley | F41A 27/06 | 89/36.13 |
| 3,138,994 | A * | 6/1964 | Blunk | F41A 23/00 | 224/931 |
| 3,309,962 | A * | 3/1967 | Lykam | F41G 3/20 | 89/41.19 |
| 8,434,397 | B1 * | 5/2013 | Deckard | F41A 9/60 | 89/37.16 |
| 8,448,561 | B2 * | 5/2013 | Carroll, III | F41A 23/60 | 89/37.03 |
| 8,578,644 | B1 * | 11/2013 | Oquin | F41G 11/003 | 89/37.03 |

* cited by examiner

*Primary Examiner* — Bret Hayes

(74) *Attorney, Agent, or Firm* — Schmeiser, Olsen & Watts LLP

(57) ABSTRACT

A weapon training and firing aid having a shoulder bar attachment for elevating and/or traversing a weapon mount. A weapon training and firing aid has an elongate arm for attachment to a weapon mount and extending in a generally rearward direction from the weapon mount.

15 Claims, 4 Drawing Sheets

WEAPON TRAINING AND FIRING AID

CROSS REFERENCE TO RELATED APPLICATION

This application claims priority to U.S. Provisional patent application to Dennis Joseph Moore entitled "WEAPON TRAINING AND FIRING AID," Ser. No. 62/916,043, filed Oct. 16, 2019, the disclosures of which are hereby incorporated entirely herein by reference.

BACKGROUND OF THE INVENTION

Technical Field

This invention relates generally to armaments, and particularly to a weapon training and firing aid comprising a shoulder bar attachment for elevating and/or traversing a weapon mount.

State of the Art

Conventional crew-served weapon mounts, such as the U.S. Military Model Mk93, for example, and other U.S. and International weapon mounts, rely on powered or mechanical devices to traverse and elevate the weapon. Such devices are generally integral to the mount. When faced with multiple targets in various directions and/or at different ranges, the mechanical movement is typically very slow. If a user chooses to bypass these mechanical traversing and elevation devices, the systems, then described as "free", become heavy, unstable, and inaccurate. Accordingly, there is a need for a means of stabilizing and improving the accuracy of a weapon, mounted to a weapon mount, while free of a mechanical traversing and/or elevating device.

SUMMARY OF THE INVENTION

The present invention relates to armaments, and particularly to a weapon training and firing aid comprising a shoulder bar attachment for elevating and/or traversing a weapon mount.

A weapon training and firing aid may comprise an elongate arm configured to be coupled to a weapon mount, such as an Mk93 weapon mount, for example, without modification of the weapon mount, wherein a first end of the weapon training and firing aid is coupled to the weapon mount and the arm extends in a generally rearward direction from the weapon mount.

In some embodiments, the arm of a weapon training and firing aid may be articulatable. In some embodiments, the arm may comprise a plurality of segments removably coupled together, wherein various segments of the arm may be detachable, removable, telescoping, or otherwise extendable and retractable.

A weapon training and firing aid, once coupled to a weapons mount, gives a user a stable method of supporting and moving the weapon, allowing the user to quickly elevate and traverse the weapon mount. This is accomplished by giving the user an additional point of contact, for example at the shoulder or under the arm, to support and stabilize the weapon mount.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in conjunction with the Figures, wherein like reference numbers refer to similar items throughout the Figures, and:

DETAILED DESCRIPTION OF EMBODIMENTS OF THE INVENTION

As discussed above, embodiments of the present invention relate to armaments, and particularly to a weapon training (aiming) and firing aid comprising a shoulder bar attachment, giving leverage to a user for manual and rapid training of a weapon mounted to the weapon mount, by quickly and accurately elevating and/or traversing the weapon mount.

Figure 1:
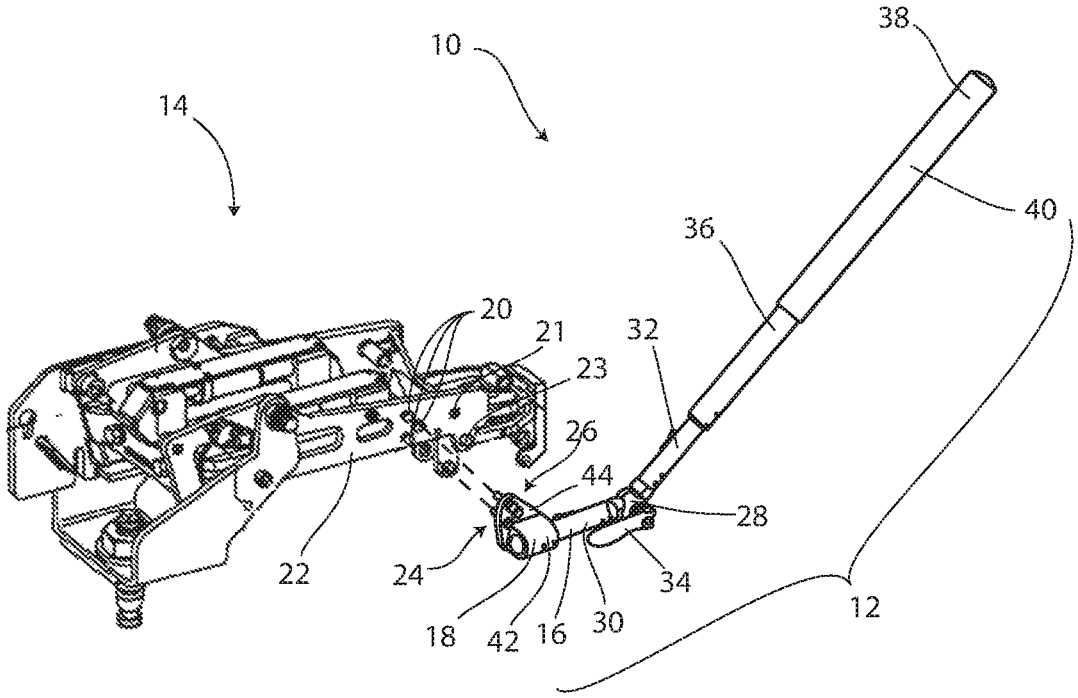
FIG. 1 is a perspective view of an embodiment of a weapon training and firing aid detached from a conventional Mk93 weapon mount showing points of attachment of the weapon training and firing aid to the Mk93 weapon mount.
Figure 2:
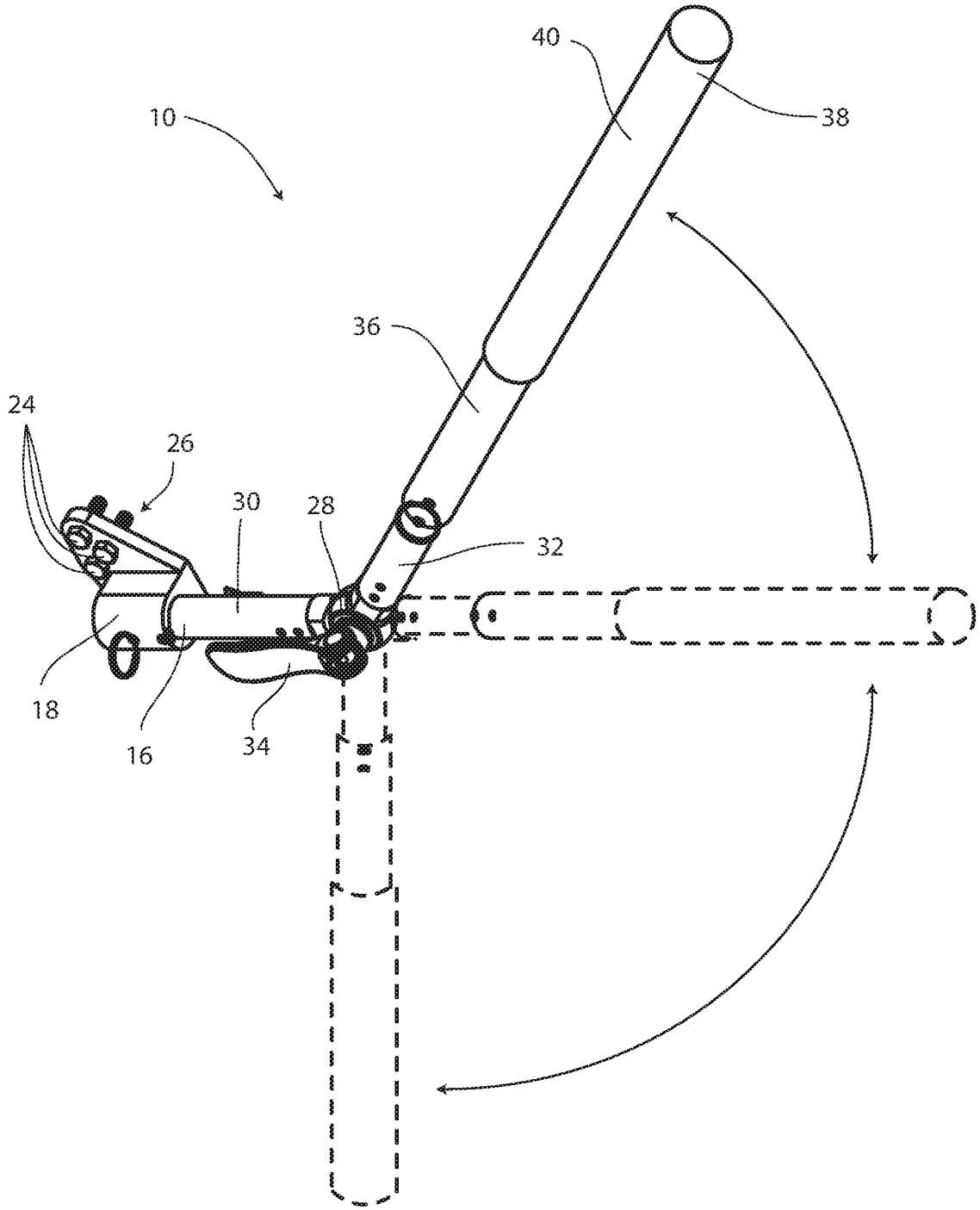
FIG. 2 is a perspective view of a weapon training and firing aid, according to an embodiment.
Figure 3:
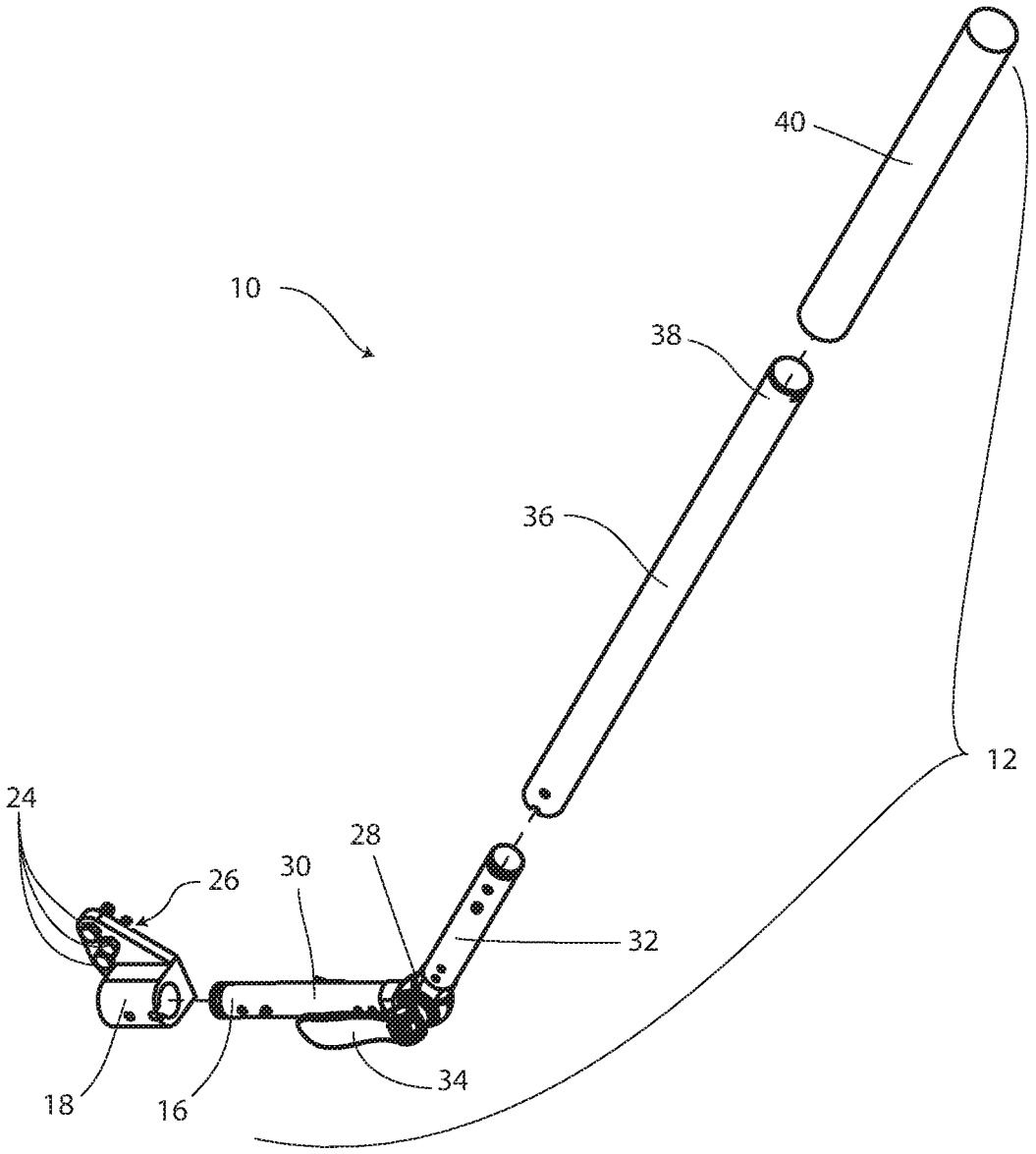
FIG. 3 is an exploded view of a weapon training and firing aid, according to an embodiment.

Referring to the drawings, FIGS. 1-3 illustrate a weapon training and firing aid 10, according to an embodiment. A weapon training and firing aid 10 may comprise an elongate arm 12 configured to be coupled to a weapon mount 14, such as an Mk93 weapon mount, for example, without modification of the weapon mount 14, wherein a first end 16 of the weapon training and firing aid 10 is coupled to the weapon mount 14 and the arm 12 extends in a generally rearward direction from the weapon mount 14, as shown in FIG. 1.

Figure 4:
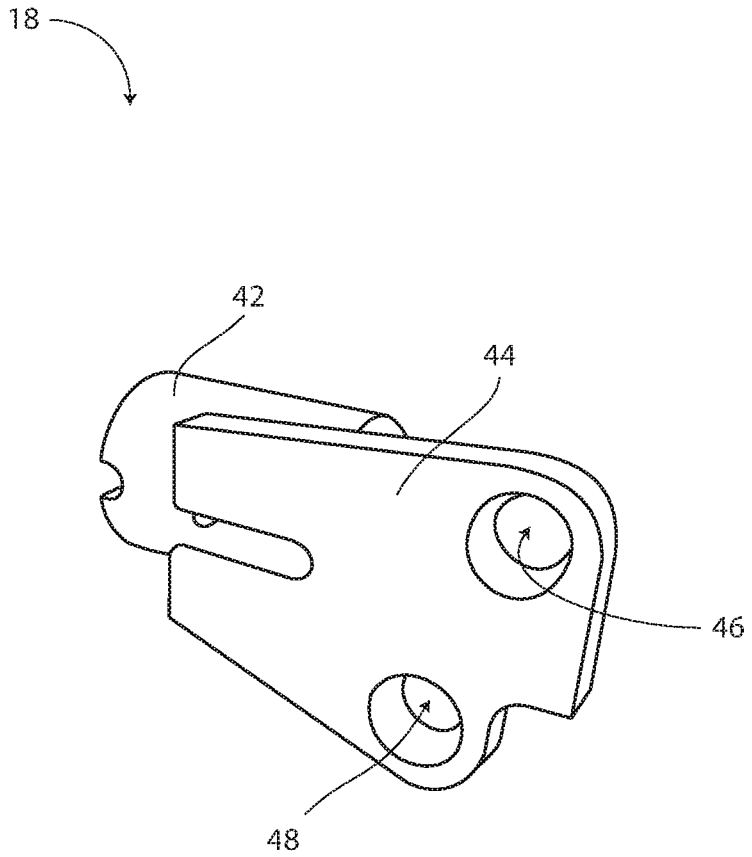
FIG. 4 is a perspective view of a mounting bracket of a weapon training and firing aid; according to an embodiment.

A weapon training and firing aid 10, of the present invention may comprise a mounting bracket 18 for coupling the arm 12 to a weapon mount 14. For example, the Mk93 weapon mount 14, shown in FIG. 1, comprises three apertures 20 through a side member 22 thereof to which the mounting bracket 18 is configured to be coupled by insertion of three mounting bolts 24 through corresponding mounting bolt apertures 26 in the mounting bracket 18, respectively, and into the apertures 20 of the weapon mount 14, wherein the mounting bolts 24 may be secured with nuts. Alternatively, in some embodiments, the three mounting bolts 24 may be threaded into the corresponding threaded apertures of a linear guide mount of the Mk93 weapon mount, within the side member 22 thereof opposite the mounting bracket 18. Although the mounting bracket 18, as shown in the drawings, and described above, is configured to be coupled to a conventional Mk93 weapon mount by use of three mounting bolts 24, this is not intended to be limiting. An Mk93 weapon mount may comprise a quick-release pin that may be utilized in the place of one of the three mounting bolts 24, as described above. In some embodiments, a weapon training and firing aid may be configured to be coupled to an Mk93 weapon mount by an embodiment of a mounting bracket 18, as shown in FIG. 4, wherein the mounting bracket 18 comprises a sleeve 42 for receiving an arm 12 of the weapon training and firing aid 10 into, and a plate 44 coupled to the sleeve 42. The plate 44 may comprise a first aperture 46 therethrough and a second aperture 48 therethrough, corresponding to a first rear aperture 21 and a second rear aperture 23 in the side member 22, respectively, as shown in FIG. 1. The embodiment of mounting bracket 18, as shown in FIG. 4 may be coupled to the Mk93 weapon mount by inserting a first mounting bolt 24 through the first aperture 46 and first rear aperture 21 and inserting a second mounting bolt 24 through the second aperture 48 and second rear aperture 23, wherein each of the first and second mounting bolts are secured with nuts. Some embodiments of a conventional Mk93 weapon mount comprise a quick-release pin inserted through the second rear aperture 23. In some embodiments, the second mounting bolt 24 inserted through the second aperture 48 and second rear aperture 23, as described, may be replaced by the conventional quick-release pin (not shown) of the Mk93 weapon mount inserted through the second aperture 48 and second rear aperture 23. Alternatively, in some embodiments, the first mounting bolt 24 inserted through the first aperture 46 and first rear aperture 21, as described, may be replaced by the conventional quick-release pin of the Mk93 weapon mount inserted through the first aperture 46 and first rear aperture 21. Embodiments of a conventional Mk93 weapon mount may comprise the quick-release pin removably coupled thereto, which may be used for this purpose. In some embodiments, the arm 12 may be releasably coupled within sleeve 42 of a mounting bracket 18, wherein the mounting bracket 18 may remain coupled to the weapon mount 14, while a user may quickly and easily remove the arm 12 from the sleeve 42, such as for storage, for example, and/or replace the arm 12 within the sleeve 42, without the need to remove the mounting bracket 18 from the weapon mount 14. A weapon training and firing aid 10 may be configured to be similarly coupled to any of a variety of weapon mounts 14, known now or in the future, and by any of a variety of coupling means, known now or in the future. For example, embodiments of a weapon training and firing aid 10 may be coupled to a weapon mount 14 by one or more screws, clips, pins, quick-release pins, clamping devices, and the like, with or without a mounting bracket 18, wherein the weapon training and firing aid 10 is configured to be coupled to the weapon mount 14 without modification of the weapon mount 14. Furthermore, a weapon training and firing aid 10 may be coupled to either side, or to any other suitable mounting point, of a weapon mount 14.

In some embodiments, the arm 12 of a weapon training and firing aid 10 may be articulatable. For example, in some embodiments, an arm 12 may comprise at least one joint 28 therein, wherein the at least one joint 28 allows segments of the arm 12 to rotate relative to each other in order to conform the arm 12 to a desirable configuration. The embodiment shown in FIG. 2 comprises a single joint 28 coupled between a first segment 30 of the arm 12 and a second segment 32 of the arm 12, wherein the second segment 32 is rotatable about the joint 28 relative to the first segment 30. The joint 28, as shown in FIG. 2, may be a spring-loaded splined joint 28 secured by a quick-release mechanism 34, wherein the second segment 32 is rotatable about the joint 28 in incremental stops of equal or varying degrees of rotation while the quick-release mechanism 34 is in a disengaged position and the second segment 32 is not rotatable about the joint 28 while the quick-release mechanism 34 is in an engaged position. In practice, a user may disengage the quick-release mechanism 34, rotate the second segment 32 of the arm 12 to a desired configuration, and engage the quick-release mechanism 34 to secure the second segment 32 in the desired configuration. The quick-release mechanism 34, as shown in FIG. 2, may be large enough to be manipulated by a user wearing gloves. However, this is not intended to be limiting. The at least one joint 28 may be any of a variety of hinged joints, whether ball-and-detent or not, splined or not, having stops or not, spring-loaded or not, and the like, or any combination thereof, known now or in the future, and securable by any of a variety of securing means, known now or in the future, whereby at least one segment of the arm 12 may be rotatable about the at least one joint 28 while a securing means of the at least one joint 28 is in a disengaged position and not rotatable about the at least one joint 28 while the securing means of the at least one joint 28 is in a disengaged position.

In some embodiments, the arm 12 may comprise a single component of unitary construction. In other embodiments, the arm 12 may comprise a plurality of segments removably coupled together. For example, as illustrated by the exploded view shown in FIG. 3, the distal segment 36 of the arm 12 is removable from that segment 32 of the arm 12 proximate the joint 28. In some embodiments, various segments of the arm 12 may be telescoping, or otherwise extendable and retractable, such as by a securable slide mechanism, for example.

In operation, a weapon training and firing aid 10 may be coupled to a weapon mount 14, as described, wherein a distal end 38 of the arm 12 of the weapon training and firing aid 10 may be disposed over a user's shoulder or under the user's arm, as may be desired, for example, wherein the user may be a gunner positioned behind the weapon mount 14, relative to the direction of fire, leaving the user's hands free to engage and manipulate any of a weapon system, light, laser, sighting system, and the like, mounted to the weapon mount 14, or to direct any light, laser, illumination device, aiming device, fire control device, coaxial-mounted weapon, and the like, or any combination thereof, mounted to the weapon mount 14 or mounted secondarily to a primary weapon mounted thereto. The user may utilize his or her body to stabilize and control direction and aiming of the weapon by engaging the distal end 38 of the arm 12, for example, with the user's shoulder and neck or the user's side and underarm, accordingly, or by any other suitable body part. The length of the arm 12, extending from the weapon mount 14, provides additional leverage, control, and a sense of direction to the user, while elevating and/or traversing the weapon, not otherwise available to the user without the weapon training and firing aid 10. The additional leverage provided by the arm 12 further allows a user to more quickly traverse and/or elevate any system coupled to the weapon mount 14 than without the weapon training and firing aid 10. A weapon training and firing aid 10 may be used by a user in any of a variety of firing positions, such as while standing, kneeling, or sitting, for example, and while the weapon mount 14 is attached to any of a variety of base platforms, such as to a vehicular gun ring, swing arm mounting, pedestal, tripod, and the like.

Some embodiments may comprise a pad 40 coupled to the distal end 38 of the arm 12, for providing comfort to a user in contact with the arm 12. For example, as shown in FIGS. 1-3, a tubular pad 40 may be removably coupled around the distal end 38. The pad 40 may be coupled to and removed from the arm 12 by simply sliding the pad 40 on or off of the arm 12, respectively. In addition, any of a variety of other optional components (not shown) may be coupled to or integrated with a weapon training and firing aid 10, of the present invention, including, without limitation, any of a variety of handgrips, electronic controls, firing aid **10*s*, sighting aid 10*s***, and the like, and/or any combination thereof.

The components defining any weapon training and firing aid 10, of the present invention, may be formed of any of many different types of materials or combinations thereof that can readily be formed into shaped objects provided that the components selected are consistent with the intended operation of a weapon training and firing aid 10. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as copper, zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any weapon training and firing aid 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, sewing, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

What is claimed is:

1. A weapon training and firing aid, comprising an elongate arm, wherein the arm comprises a first end configured to be coupled to a weapon mount without modification of the weapon mount and an opposed distal end extending in a rearward direction therefrom; and wherein the arm comprises:

a first segment;

a second segment; and a joint coupled between the first segment and the second segment, wherein the second segment is rotatable about the joint with respect to the first segment.

2. The weapon training and firing aid of claim 1, wherein the weapon mount is an Mk93 machine gun mount.

3. The weapon training and firing aid of claim 1, further comprising a mounting bracket configured to be coupled between the arm and the weapon mount, wherein the mounting bracket comprises:

a sleeve configured to receive a first end of the arm removably coupled thereinto; and a plate coupled to the sleeve, wherein the plate comprises a plurality of apertures therethrough, wherein each of the plurality of apertures corresponds to one of a plurality of apertures through a side member of the weapon mount for coupling the plate to the side member by mounting bolts inserted through the corresponding apertures, respectively.

4. The weapon training and firing aid of claim 1, wherein the joint is a splined joint releasably securable by a quick-release mechanism, wherein the quick-release mechanism is changeable between an engaged position and a disengaged position.

5. The weapon training and firing aid of claim 1, wherein the arm further comprises a third segment removably coupled to and coaxial with the second segment.

6. The weapon training and firing aid of claim 5, further comprising a pad coupled to the distal end of the arm.

7. The weapon training and firing aid of claim 6, wherein the pad is a tubular member configured to be removably and slidingly coupled over the distal end of the arm.

8. A weapon training and firing aid, comprising:

a mounting bracket, comprising:

a plate configured to be coupled to a weapon mount without modification of the weapon mount; and a sleeve coupled to the plate;

an elongate arm, comprising:

a first segment, comprising:

a first end removably coupled within the sleeve; and an opposed second end;

a second segment, comprising:

a third end; and an opposed fourth end;

a joint operationally coupled between the second end and the third end, wherein the second segment is rotatable about the joint with respect to the first segment;

a third segment, comprising:

a fifth end removably coupled to the fourth end, wherein the third segment is coaxial with the second segment; and an opposed sixth end; and a tubular pad slidingly and removably coupled over the sixth end.

9. The weapon training and firing aid of claim 8, wherein the weapon mount is an Mk93 machine gun mount.

10. The weapon training and firing aid of claim 9, wherein the plate comprises three mounting bolt apertures therethrough, wherein each of the three mounting bolt apertures corresponds to one of three apertures through a side member of the weapon mount for coupling the plate to the side member by three mounting bolts inserted through the corresponding apertures, respectively.

11. The weapon training and firing aid of claim 10, wherein each of the three mounting bolts is configured to be threaded into a linear guide mount of the weapon mount when the weapon training and firing aid is coupled to the weapon mount.

12. The weapon training and firing aid of claim 9, wherein the plate comprises a first mounting bolt aperture therethrough, corresponding to an upper rear aperture through a side member of the weapon mount, and a second mounting bolt aperture therethrough, corresponding to a lower rear aperture through the side member, wherein the plate is configured to be coupled to the side member by a first mounting bolt inserted through the first mounting bolt aperture and the upper rear aperture and secured by a first nut, and a second mounting bolt inserted through the second mounting bolt aperture and the lower rear aperture and secured by a second nut.

13. The weapon training and firing aid of claim 9, wherein the plate comprises a first mounting bolt aperture therethrough, corresponding to an upper rear aperture through a side member of the weapon mount, and a second mounting bolt aperture therethrough, corresponding to a lower rear aperture through the side member, wherein the plate is configured to be coupled to the side member by a first mounting bolt inserted through the first mounting bolt aperture and the upper rear aperture and secured by a first nut, and a quick-release pin of the weapon mount inserted through the second mounting bolt aperture and the lower rear aperture.

14. The weapon training and firing aid of claim 9, wherein the plate comprises a first mounting bolt aperture therethrough, corresponding to an upper rear aperture through a side member of the weapon mount, and a second mounting bolt aperture therethrough, corresponding to a lower rear aperture through the side member, wherein the plate is configured to be coupled to the side member by a first mounting bolt inserted through the second mounting bolt aperture and the lower rear aperture and secured by a first nut, and a quick-release pin of the weapon mount inserted through the first mounting bolt aperture and the upper rear aperture.

15. The weapon training and firing aid of claim 9, wherein the joint is a splined joint releasably securable by a quick-release mechanism, wherein the quick-release mechanism is changeable between an engaged position and a disengaged position.

* * * * *